US005654735A

United States Patent [19]

Nakajima

[11] Patent Number: 5,654,735

[45] Date of Patent: Aug. 5, 1997

[54] DISPLAY DEVICE

[75] Inventor: Yoshiharu Nakajima, Kanagawa, Japan

[73] Assignee: Sony Corporation, Japan

[21] Appl. No.: 542,704

[22] Filed: Oct. 13, 1995

[30] Foreign Application Priority Data

Oct. 19, 1994 [JP] Japan ..... 6-280101

[51] Int. Cl.[6] ..... G09G 3/36

[52] U.S. Cl. ..... 345/99; 348/555

[58] Field of Search ..... 345/99, 104; 348/555

[56] References Cited

U.S. PATENT DOCUMENTS 4,536,800 8/1985 Parker ..... 345/109
4,536,856 8/1985 Hiroishi ..... 345/99
5,357,290 10/1994 Horibe ..... 348/555 X

FOREIGN PATENT DOCUMENTS 4-116687 4/1992 Japan .

*Primary Examiner*—Mark R. Powell

*Attorney, Agent, or Firm*—Ronald P. Kananen

[57] ABSTRACT

A display device comprising a display panel having pixels arrayed at intersections of mutually orthogonal gate lines and data lines, and a driving circuit for sampling a plurality of video signals simultaneously and distributing the sampled signals concurrently to a predetermined number of data lines; a video driver for relatively delaying the video signals in accordance with the array pitch of the pixels and adjusting the supply timing of the video signals to the display panel; and a timing generator for controlling the simultaneous sampling period of a driving circuit included in the display panel and also controlling the timing of the delay process executed by the video driver. The timing generator is capable of selectively switching the simultaneous sampling period and controlling the delay process timing of the video driver in response to such selective switching to thereby optimize, with respect to the simultaneous sampling period, the supply timing of the input video signals to the display panel. This display device is adapted to prevent occurrence of a vertical streak ghost in a simultaneous multiple-pixel sampling mode.

12 Claims, 3 Drawing Sheets

1
DISPLAY PANEL
AR
AG
AB
202
D/A
D/A
D/A
φREAD
2
DR
DG
DB
203
MEMORY
PROCESSOR
204
TIMING GENERATOR
3
201
A/D
VIDEO
SYNC

DISPLAY DEVICE

BACKGROUND OF THE INVENTION

1. Field of the Invention

The present invention relates to a display device comprising a display panel, a video driver and a timing generator. And, more particularly, the invention relates to a driving control technique for a display device adopting a simultaneous multiple-pixel sampling method.

2. Description of Related Art

The simultaneous multiple-pixel sampling method is dominant as a system for driving a display panel which is represented by an active-matrix liquid crystal display panel or the like, and its one example is disclosed in Japanese Patent Laid-open No. Hei 4 (1992)-116687. According to this method, a color display panel has a plurality of data lines which are disposed in parallel with one another vertically and are so arranged that successive three lines thereof form a set of red (R), green (G) and blue (B). The display panel also has a plurality of gate lines disposed in parallel with one another horizontally, and pixel electrodes connected via switching elements respectively to the intersections of the data lines and the gate lines. The pixel electrodes are so disposed that alternate ones in the vertical (column) direction have a positional deviation corresponding to a half of the pixel array pitch in the horizontal (row) direction, and vertically alternate ones are connected to the left and right data lines alternately. In addition, the color display panel also has a plurality of horizontal switches provided correspondingly to the data lines, and further three video lines connected via the horizontal switches to the data lines of the individual colors so as to receive R, G, B video signals supplied from the video driver. In this configuration, a horizontal driving circuit is provided for simultaneously controlling the horizontal switches per set of R, G, B, so that three R, G, B pixels are simultaneously driven for sampling. And a delay means is provided in the video driver for relatively giving a predetermined delay, which corresponding to the pixel pitch, to each of the R, G, B video signals supplied to the three video lines. Thus, the delay corresponding to the pixel pitch is relatively given to the R, G, B video signals, and the on/off actions of the horizontal switches per set of R, G, B are controlled simultaneously, so that it becomes possible to curtail the number of required stages of the horizontal driving circuit (e.g., shift registers) for driving the horizontal switches, hence simplifying the configuration with a reduction of the power consumption to thereby display a satisfactory color picture. Since the on/off actions of the R, G, B horizontal switches are controlled simultaneously by sampling pulses outputted from the shift registers, the number of the required shift registers can be reduced to ⅓, and the frequency of a horizontal transfer clock signal Supplied from the timing generator is lowered also to ⅓.

In any display device adopting the simultaneous multiple-pixel sampling method, there exists a problem in principle that a phenomenon of vertical streak ghost is caused under specific conditions. For example, such a ghost occurs when changes of video signals supplied to its display panel are slow and the change time is longer than the sampling time allocated to the multiple pixels. Even when the change time of video signals supplied to the display panel is sufficiently fast, there still occurs a ghost if the closing of any horizontal switch incorporated in the display panel is coincident in timing with the change region. The first condition is prone to be induced readily if the number of horizontal pixels is increased in the display panel and the frequency $^{f}$HCK of a horizontal transfer clock signal is higher. And the second condition, which is induced or not in dependence on the frequency $^{f}$HCK, is rendered more prone to occur with a rise of the frequency $^{f}$HCK. In any of the conventional display panels known heretofore, the number of pixels is not so many that the above conditions are satisfied. Namely, the frequency $^{f}$HCK is not so high. And the horizontal driving circuit incorporated in the display panel operates substantially at a fixed frequency $^{f}$HCK in most cases, so that there never occurs a state where the horizontal driving circuit is placed in the above-described specific conditions while being dislodged from the optimal condition once set. However, in any of the superhigh-precision display panels developed of late extensively, it is extremely difficult to find the optimal condition while excluding the aforementioned specific conditions and still ensuring a certain margin. In other words, extraordinarily strict specifications are required in design. And in displaying pictures of various signal standards including a 16:9 aspect ratio and so forth correspondingly to multimedia, the frequency of the horizontal transfer clock signal in the display panel is changed in diversified ways to consequently bring about further difficulties in finding the optimal condition.

SUMMARY OF THE INVENTION

It is therefore an object of the present invention to provide a display device capable of preventing generation of a vertical streak ghost in simultaneous multiple-pixel sampling.

According to one aspect of the present invention, the display device comprises a display panel, a video driver and a timing generator in its fundamental constitution. The display panel has pixels arrayed at intersections of mutually orthogonal gate lines and data lines, and a driving circuit for sampling a plurality of video signals simultaneously and distributing the sampled video signals concurrently to a predetermined number of data lines. The video driver previously delays the plurality of video signals relatively in accordance with the pixel array pitch to thereby adjust the timing of supplying the video signals to the display panel. The timing generator controls the simultaneous sampling period of the driving circuit included in the display panel and also controls the timing of the delay process executed by the video driver. As a characteristic requisite of the invention, the timing generator is capable of selectively switching the simultaneous sampling period and controlling the delay process timing of the video driver in response to such selective switching to thereby optimize the timing of supplying the video signals, which are to be inputted to the display panel, with respect to the simultaneous sampling period. More specifically, the video driver has a sample hold circuit to execute a process of delaying the video signals. In this case, the timing generator outputs both a latch signal to prescribe the delay process timing of the sample hold circuit and a clock signal to prescribe the simultaneous sapling period of the driving circuit. In this configuration, the timing generator adjusts the phase difference between the latch signal and the clock signal to thereby optimize the video-signal supply timing.

According to another aspect of the present invention, the display device comprises a display panel, a video driver and a timing generator in its fundamental constitution. The display panel has pixels arrayed at intersections of mutually orthogonal gate lines and data lines, and a driving circuit for sampling a plurality of video signals simultaneously and distributing the sampled video signals concurrently to a predetermined number of data lines. The video driver previously delays the plurality of video signals in accordance with the pixel array pitch to thereby adjust the timing of supplying the video signals to the display panel. The timing generator controls the timing of the simultaneous sampling while supplying a clock signal to the driving circuit included in the display panel, and also controls the delay process of the video driver synchronously. As a characteristic requisite of the invention, the timing generator variably controls the timing of the delay process executed by the video driver and optimizes the timing of supplying the video signals, which are to be inputted to the display panel, with respect to the timing of the simultaneous sampling. For example, the timing generator variably controls the delay process timing in accordance with the video-signal transfer delay caused in the video driver. Or the timing generator variably controls the delay process timing in accordance with the clock-signal transfer delay caused in the driving circuit. In a preferred embodiment, the video driver has a sample hold circuit to execute a process of delaying the video signals. The timing generator outputs a latch signal to prescribe the delay process timing of the sample hold circuit. In this configuration, the timing generator adjusts the phase difference between the latch signal and the clock signal to thereby optimize the video-signal supply timing.

In the aforementioned one aspect of the present invention, the display device is capable of performing proper operations for any video signals of various different standards. More specifically, the timing generator supplies a horizontal transfer clock signal of a predetermined period to the display panel in accordance with the standard of the video signal and selectively switches the simultaneous sampling period in conformity to the video signal standard. Further, the timing generator controls the delay process timing of the video driver in response to such selective switching to thereby optimize the timing of supplying the input video signals to the display panel. Consequently, it becomes possible to suppress generation of a vertical streak ghost. Meanwhile, in the second aspect of the present invention, the timing generator variably controls the timing of the delay process executed by the video driver, hence optimizing the video-signal supply timing to the display panel with respect to the timing of the simultaneous sampling. Or, the timing generator variably controls the delay process timing in accordance with the clock-signal transfer delay caused in the horizontal driving circuit. Due to such configuration, it becomes possible to eliminate a vertical streak ghost.

The above and other features and advantages of the present invention will become apparent from the following description which will be given with reference to the illustrative accompanying drawings.

DESCRIPTION OF PREFERRED EMBODIMENTS

Figure 1:
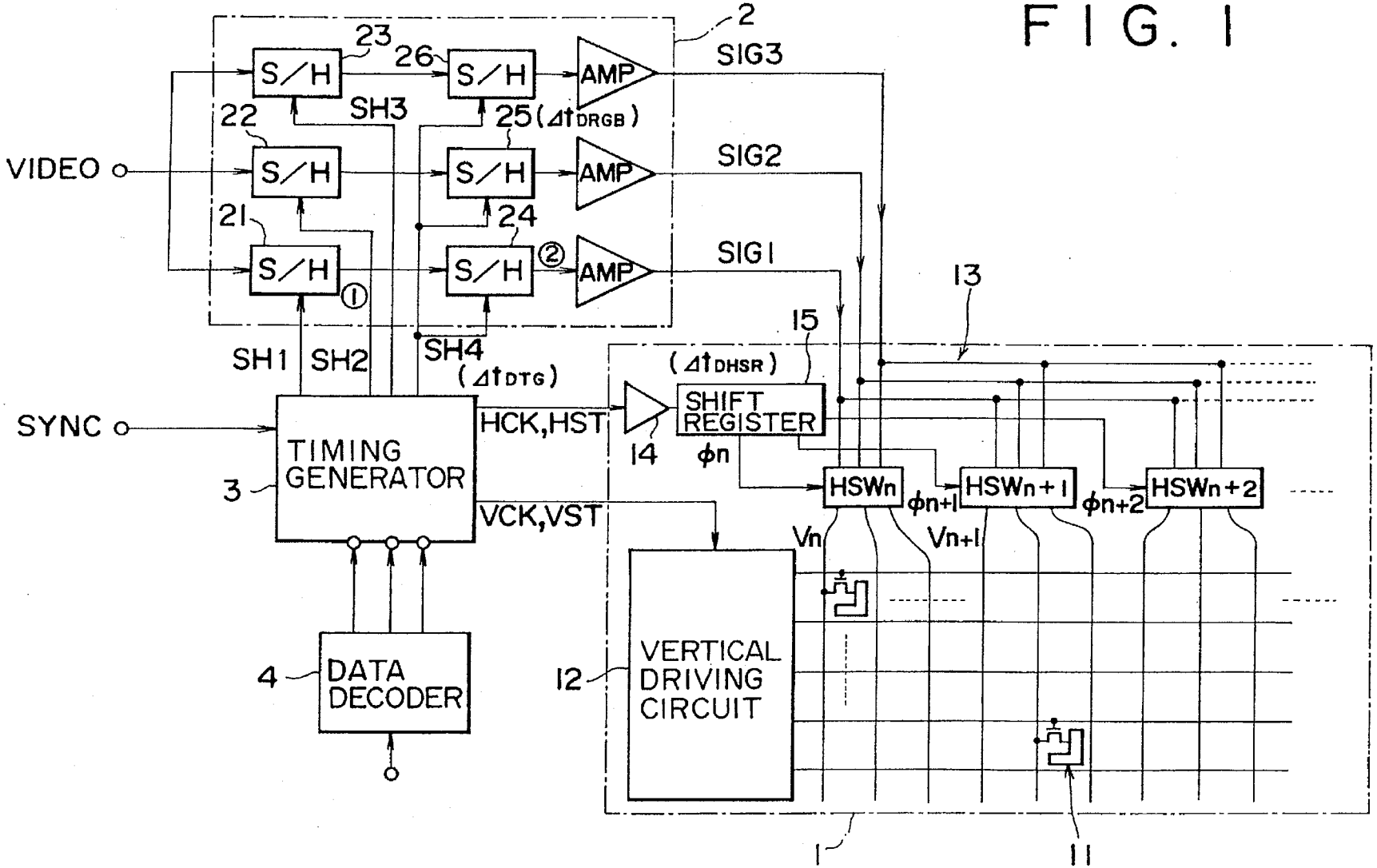
FIG. 1 is a block diagram showing a fundamental constitution of the display device of the present invention.

Hereinafter preferred embodiments of the present invention will be described in detail with reference to the accompanying drawings. FIG. 1 is a block diagram showing a fundamental constitution of the display device according to the present invention. This display device comprises a display panel 1, a video driver 2 and a timing generator 3. The display panel 1 has a pixel array section and a peripheral driving circuit section. The pixel array section includes pixels 11 arrayed at intersections of mutually orthogonal gate lines X and data lines Y. Each of the pixels 11 consists of a set of a pixel electrode and a thin film transistor. A gate electrode of the thin film transistor is connected to a corresponding gate line, a source electrode thereof is connected to a corresponding data line Y, and a drain electrode thereof to a corresponding pixel electrode, respectively. Although not shown, a counter electrode is disposed opposite to the pixel electrode via a predetermined gap, and a liquid crystal is sealed up in such a gap. The peripheral driving circuit section is divided into a vertical driving circuit 12 and a horizontal driving circuit 13. The vertical driving circuit 12 is connected to each gate line X and selects pixels 11 of one line sequentially. More specifically, the vertical driving circuit 12 includes a shift register and transfers vertical start pulses VST sequentially in response to a vertical transfer clock signal VCK and outputs a gate pulse to each gate line X. Meanwhile the horizontal driving circuit 13 samples a plurality of video signals SIG1, SIG2, SIG3 simultaneously and distributes the sampled signals concurrently to a predetermined number (three in this embodiment) of data lines Y. More concretely, the horizontal driving circuit 13 includes an input buffer 14, a shift register 15 and a plurality of horizontal switches HSWn, HSWn+1, HSWn+2, . . . . and so forth. Each horizontal switch HSW is connected to three data lines Y. The above-described three video signals SIG1, SIG2, SIG3 are sampled simultaneously in the corresponding three data lines Y via the relevant horizontal switch HSW. The shift register 15 transfers horizontal start pulses HST sequentially in response to a horizontal transfer clock signal HCK inputted via the buffer 14 and outputs sampling pulses $\phi_n$, $\phi_{n+1}$, $\phi_{n+2}$, . . . and so forth. The on/off action of the corresponding horizontal switch HSW is controlled in accordance with the sampling pulse $\phi$, and the aforementioned simultaneous sampling is performed. As obvious from the above description, the horizontal transfer clock signal HCK prescribes the period of such simultaneous sampling.

The video driver 2 previously delays the plurality of video signals SIG1, SIG2, SIG3 relatively in accordance with the array pitch of the pixels 11 so as to adjust the timing of supplying the video signals to the display panel 1. The video driver 2 employed in this embodiment is formed into an analog structure and has a sample hold circuit which delays video signals. The sample hold circuit consists of three front-stage sample hold (S/H) units 21, 22, 23 provided for the three kinds of video signals SIG1, SIG2, SIG3 and three rear-stage S/H units 24, 25, 26 connected to the front-stage units respectively. A pair of the front-stage S/H unit 21 and the rear-stage S/H unit 24 constitute a delay channel corresponding to the video signal SIG1. Similarly, a pair of the front-stage S/H unit 22 and the rear-stage S/H unit 25 constitute a delay channel corresponding to the video signal SIG2, and a pair of the front-stage S/H unit 23 and the rear-stage S/H unit 26 constitute a delay channel corresponding to the video signal SIG3. The front-stage S/H units 21, 22, 23 are controlled independently of one another, while the rear-stage S/H units 24, 25, 26 are controlled synchronously with one another. An amplifier AMP is connected to the output stage of each delay channel. In this embodiment, a monochromatic video signal VIDEO is distributed to three delay channels, which then output three video signals SIG1, SIG2, SIG3 delayed relatively. The format of the input video signal VIDEO may be based on any of various standards such as NTSC, NTSC WIDE, HD or VGA. Although a monochromatic video signal is inputted in this embodiment, it is also possible to input three kinds of video signals, which are divided into three primary colors (R, G, B), to the delay channels respectively. In this case, the visual representation on the display panel 1 is performed in full colors.

The timing generator 3 controls the simultaneous sampling period of the horizontal driving circuit 13 incorporated in the display panel 1 and further controls the timing of the delay process executed by the video driver 2. More specifically, the timing generator 3 operates in response to a synchronizing signal SYNC inputted from an external source and supplies the aforementioned horizontal start pulse HST, horizontal transfer clock signal HCK, vertical start pulse VST and vertical transfer clock signal VCK to the display panel 1 to control the driving thereof. The timing generator 3 also supplies a plurality of latch signals SH1, SH2, SH3, SH4 to the sample hold circuit in the video driver 2. These latch signals serve to prescribe the processing timing of the delay channels included in the sample hold circuit. More specifically, the latch signal SH1 initially operates the first front-stage S/H unit 21 to perform an intermittent sampling action, then the latch signal SH2 operates the second front-stage S/H unit 22 to perform an intermittent sampling action, and the latch signal SH3 operates the third front-stage S/H unit to perform a continuous holding action. Subsequently the latch signal SH4 is outputted next to the signal SH2 to thereby operate the three rear-stage S/H units 24, 25, 26 to perform an intermittent sampling action concurrently.

One characteristic requisite of the present invention resides in that the timing generator 3 is capable of selectively switching the simultaneous sampling period and controlling the delay process timing of the video driver 2 in response to such selective switching to consequently optimize the supply timing of the input video signals SIG1, SIG2, SIG3 to the display panel 1 with respect to the simultaneous sampling period, hence realizing elimination of a vertical streak ghost. More specifically, the timing generator 3 outputs latch signals SH1, SH2, SH3, SH4 for prescribing the delay process timing of the sample hold circuit and also outputs a horizontal transfer clock signal HCK for prescribing the simultaneous sampling period of the horizontal driving circuit 13, and adjusts the phase difference ($\Delta t_{DTG}$) between the latch signal SH4 and the clock signal HCK, thereby optimizing the supply timing of the video signals SIG1, SIG2, SIG3. The above-described selective switching of the simultaneous sampling period is performed automatically in conformity with the standard of the video signal VIDEO inputted to the video driver 2. For executing this control, a data decoder 4 is connected to the timing generator 3.

Another characteristic requisite of the present invention resides in that the timing generator 3 is capable of variably controlling the timing of the delay process executed by the video driver 2, to optimize the supply timing of the input video signals SIG1, SIG2, SIG3 to the display panel 1 with respect to the timing of the simultaneous sapling. For example, the timing generator 3 variably controls the delay process timing ($\Delta t_{DTG}$) in accordance with the video-signal transfer delay ($\Delta t_{DRGB}$) caused in the video driver 2. In this example, $\Delta t_{DRGB}$ denotes the delay time in the signal processing of the amplifier AMP incorporated in the video driver 2, while $\Delta t_{DTG}$ denotes the phase difference between the latch signal SH4 and the horizontal transfer clock signal HCK at the output time of the timing generator 3, as described above. Further the timing generator 3 variably controls the delay process timing ($\Delta t_{DTG}$) in accordance with the transfer delay ($\Delta t_{DHSR}$) of the horizontal transfer clock signal caused in the horizontal driving circuit 13. In this example, $\Delta t_{DHSR}$ denotes the delay time caused in the pulse conversion of the input buffer 14 and the shift register 15.

Figure 2:
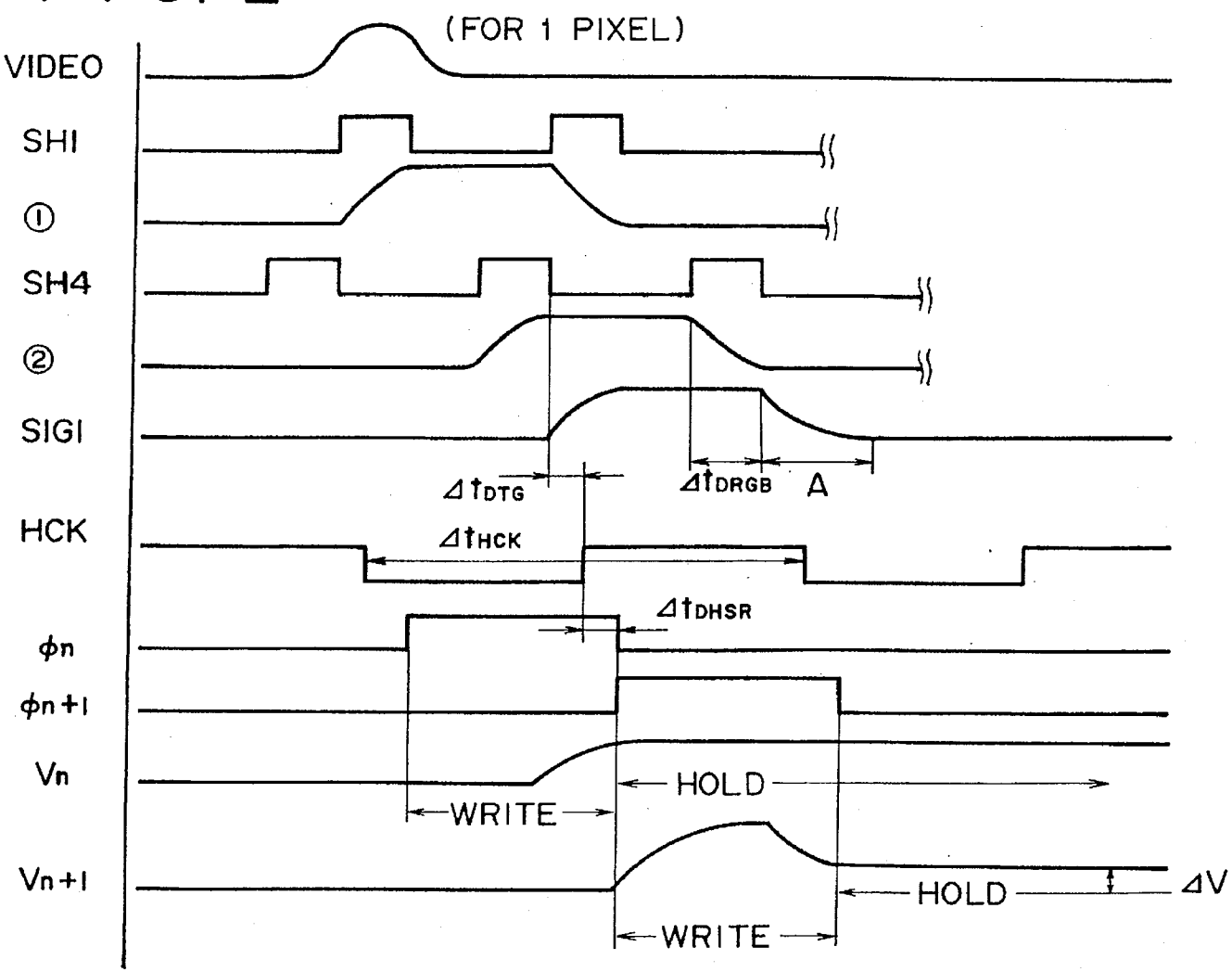
FIG. 2 is a timing chart for explaining the operation of the display device of the present invention.

Referring now to FIG. 2, the operation of the display device shown in FIG. 1 will be described in detail below. For the sake of convenience in the explanation, this timing chart represents a state prior to execution of the optimization control for elimination of a ghost. Suppose first that a video signal VIDEO for writing white in one pixel alone is inputted. It is assumed here that the display panel is in a normally black mode. A latch signal SH1 is inputted to the video driver 2 from the timing generator 3, and the front-stage S/H unit 21 of the first delay channel performs an intermittent action to thereby sample and hold the white level of the video signal VIDEO, as denoted by (1). When the latch signal SH1 is inputted at the next timing, it follows that the black level of the signal VIDEO is sampled and held. After the first latch signal SH1 is outputted, a latch signal SH4 is inputted from the timing generator 3 in accordance with the array pitch of the pixels, whereby a white-level signal denoted by (2) is outputted from the rear-stage S/H unit 24 of the first delay channel. As manifest from a comparison of (1) and (2), the video signal is delayed by an amount corresponding to two pixels. Similarly, a latch signal SH4 is outputted after the lapse of a predetermined time interval from output of the second latch signal SH1, so that the signal (2) is returned to a black level. Thereafter the signal (2) is turned via the amplifier AMP to be SIG1, which is then supplied to the display panel 1. In this case, the signal SIG1 is delayed by an amount of $\Delta t_{DRGB}$. And a fixed transition time A is further required for the signal SIG1 to turn from a white level to a black level.

Meanwhile a horizontal transfer clock signal HCK is inputted to the horizontal driving circuit 13 from the timing generator 3. One period of this signal HCK is denoted by $\Delta t_{HCK}$. As shown, there exists a phase difference of $\Delta t_{DTG}$ between the two signals SH4 and HCK. This phase difference is an adjustable parameter. The shift register 15, which functions in response to the clock signal HCK, transfers horizontal start pulses HST sequentially and outputs sampling pulses $\phi_n$, $\phi_{n+1}$, . . . and so forth sequentially. A fixed time delay of $\Delta t_{DHSR}$ is caused between the two signals. In response to the first sampling pulse $\phi_n$, the video signal SIG1 is sampled in the corresponding data line Y. The potential of this data line Y is denoted by Vn. As shown, the switch HSWn is opened upon input of the pulse $\phi_n$, so that the video signal SIG1 is written. The potential Vn written at the fall time of the pulse $\phi_n$ is settled and then is held until the next field. Since the video signal SIG1 is at a white level at the fall time of the pulse $\phi_n$, it signifies that the white level is properly written and held in the corresponding one pixel. Upon output of the next sampling pulse $\phi_{n+1}$, the switch HSWn+1 is opened so that the video signal SIG1 is sampled in the corresponding data line Y. The potential of this data line Y is denoted by Vn+1. As shown, the fall time of the pulse $\phi_{n+1}$ overlaps with the transition time region A of the video signal SIG1. Consequently, the black level fails to be completely written in the pixel, and an error $\Delta V$ is thereby generated. Under the conditions set in FIG. 2, the white level is to be written merely in the first pixel alone, and the black level is to be written in the remaining pixels. However, due to occurrence of the error $\Delta V$, a gray level, instead of the black level, is written in the pixel positioned anterior by three dots to the pixel where the white level has been written. This is the reason for occurrence of a vertical streak ghost in the simultaneous multiple-pixel sampling.

As shown in the timing chart of FIG. 2, a phenomenon of ghost may occur depending on the relationship of various delay times in the signal processing steps. The condition of inducing a ghost resides in that a sampling pulse $\phi$ falls within the transition time A of a video signal SIG inputted to the display panel 1. This condition of inducing a ghost is mathematically expressed as follows.

$$\Delta t_{DRGB}<\Delta t_{DHSR}+\Delta t_{DTG}+\Delta t_{HCK}/2\times k<\Delta t_{DRGB}+A$$

(where k=integer)

In the above expression, $\Delta t_{DRGB}$ stands for the delay time in the signal processing system from the sample hold circuit to the switch HSW, $\Delta t_{DHSR}$ stands for the delay time in the horizontal driving circuit 13 of the display panel 1, $\Delta t_{DTG}$ for the delay time of the horizontal transfer clock signal HCK to the latch signal SH4 at the output time of the timing generator 3, $\Delta t_{HCK}$ for the horizontal transfer period (i.e., $1/f_{HCK}$) Of the display panel 1, and A for the transition time of the video signal SIG inputted to the display panel 1, respectively. Further, k stands for an integer indicating the condition that, when k=1, a ghost occurs at the timing of the next sampling, and when k=2, a ghost occurs at the timing of the succeeding sampling.

The characteristic requisite of the present invention is to achieve an intentional change of $\Delta t_{DTG}$ in compliance with the status in such a manner as not to satisfy the aforementioned conditional expression. Referring back to FIG. 1 again, the explanation will be continuously given with regard to this point. The timing generator 3 is equipped with a switch for selectively changing the phase $\Delta t_{DTG}$ Of the latch signal, wherein setting of this switch is changed in compliance with the status. Data to be used for determining such setting of the switch may be either parallel data or those obtained through conversion of serial data by the data decoder 4 in consideration of an interface for a microcomputer or the like as in this embodiment. Firstly, there exists a status where $\Delta t_{DRGB}$, A and $\Delta t_{DHSR}$ in the aforementioned conditional expression are fixed, while $\Delta t_{HCK}$ (i.e., frequency $f_{HCK}$ of horizontal transfer clock signal) is changed. This status occurs when inputting video signals of various standards (e.g., video signal conforming with an aspect ration of 16:9) to the display video. In this case, $\Delta t_{DTG}$ is so adjusted as to prevent that the aforesaid conditional expression is satisfied by any change of $\Delta t_{HCK}$. Secondly, there exists another status where $\Delta t_{DRGB}$, A and $\Delta t_{HCK}$ in the conditional expression are fixed, while $\Delta t_{DHSR}$ therein is changed. This status occurs when the horizontal driving circuit in the display panel has a configuration where considerable non-uniformities are present among component elements such as thin film transistors. In this case, $\Delta t_{DTG}$ is so adjusted that the conditional expression is not satisfied in accordance with $\Delta t_{DHSR}$ of each element. And thirdly, there exists a further status where $\Delta t_{DHSR}$, $\Delta t_{DTG}$ and $\Delta t_{HCK}$ in the conditional expression are fixed, while $\Delta t_{DRGB}$ and A are changed. This status may occur when the characteristics of the video driver 2 to determine the values of $\Delta t_{DRGB}$ and A are changed. In this case, $\Delta t_{DRGB}$ is so adjusted as not to satisfy the conditional expression in accordance with the changes of $\Delta t_{DRGB}$ and A.

Figure 3:
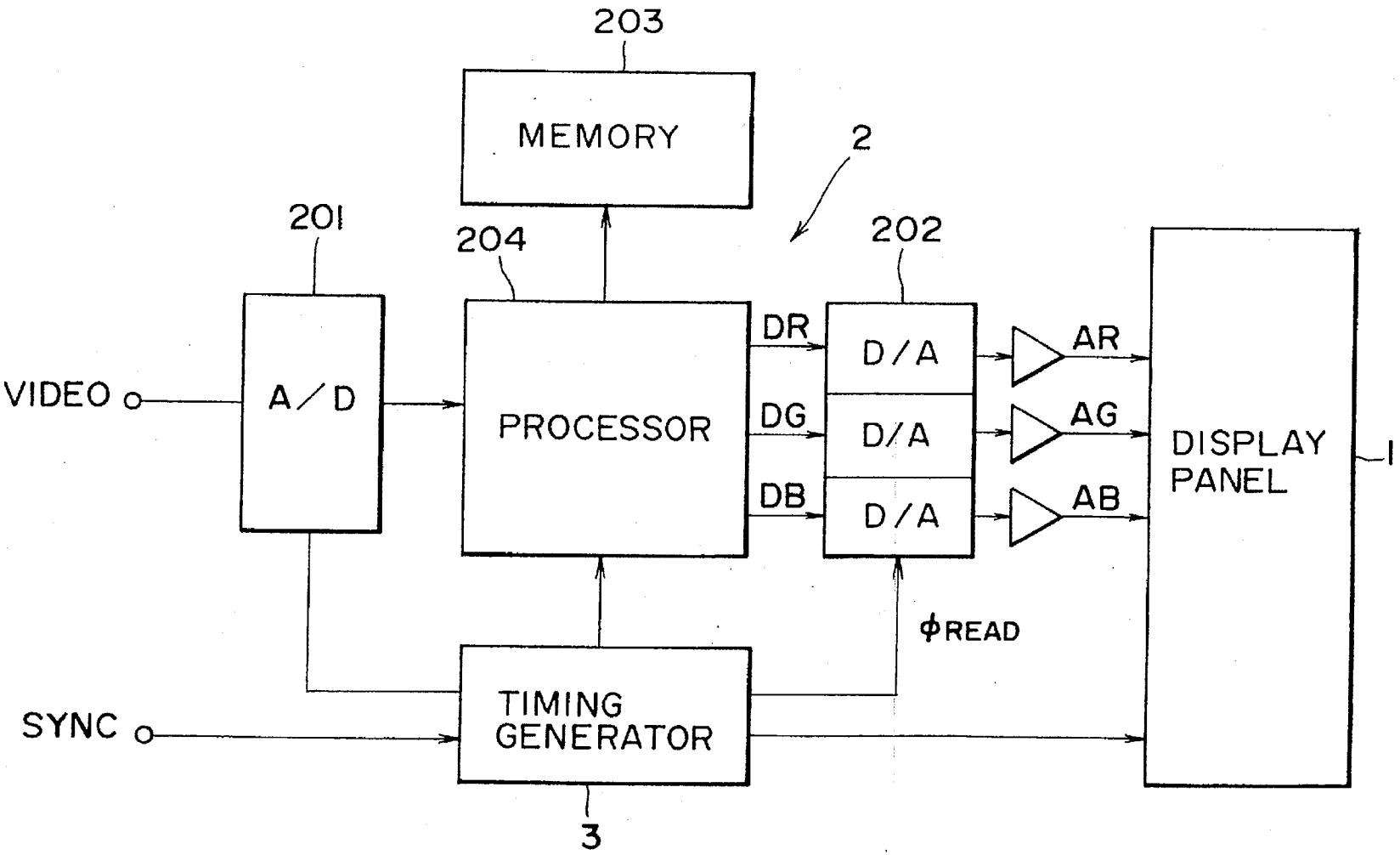
FIG. 3 is a block diagram showing another exemplary constitution of the display device of the present invention.

In the embodiment described above, an analog sample hold circuit for adjusting the timing of three pixels is provided in the video driver, and satisfaction of said conditional expression is prevented by controlling the phase $\Delta t_{DTG}$ of the latch signal supplied to the sample hold circuit. To control the phase $\Delta t_{DTG}$ signifies, in other words, to control the data change point of the video signal supplied to the display panel. Therefore, if the data change point of the video signal is controllable, it is possible to attain the same effect as the above according to the same principle even though the configuration is different from that of this embodiment. For example, in a case where a digital signal is processed in the video driver itself or in the preceding stage thereof, exactly the same control effect as in this embodiment can be achieved by controlling the read from a memory where the signal is being processed or by controlling the read timing of a D-A converter. An example of such control is shown in FIG. 3 for reference. As shown in the diagram, this display device has a display panel 1, a video driver 2 and a timing generator 3. The video driver 2 is formed for digital processing, and it comprises an A-D converter 201 positioned in an input stage, a three-channel D-A converter 202 in an output stage, a memory 203 and a processor 204. The timing generator 3 controls the phases of read pulses $\phi_{READ}$ supplied to the D-A converter 202, to thereby optimize the timing to supply analog video signals AR, AG, AB, hence realizing elimination of a vertical streak ghost. The D-A converter 202 converts the digital video signals DR, DG, DB, which are outputted from the processor 204, into sequential analog video signals AR, AG, AB in response to the pulses $\phi_{READ}$.

As described hereinabove, according to the display device of the present invention which adopts a simultaneous multiple-pixel sapling method, a phenomenon of ghost can be maximally prevented by controlling the delay process timing of the video driver and optimizing the supply timing of input video signals to the display panel, hence preventing deterioration of the picture quality. Since none of sampling action is performed in any unstable region during the changes of data, it becomes possible to avert deterioration of the uniformity in the display panel. In addition, despite input of video signals of any standard (e.g., NTSC, NTSCWIDE, HD or VGA), it is still possible to construct a superior system which is capable of preventing deterioration of both the picture quality and the uniformity that may result from a phenomenon of ghost.

Although the present invention has been described hereinabove with reference to the preferred embodiments thereof, it is to be understood that the invention is not limited to such embodiments alone, and a variety of other modifications and variations will be apparent to those skilled in the art without departing from the spirit of the invention.

The scope of the invention, therefore, is to be determined solely by the appended claims.

What is claimed is:

1. A display device comprising:

a display panel having pixels arrayed at intersections of mutually orthogonal gate lines and data lines, and a driving circuit for sampling a plurality of video signals simultaneously and distributing the sampled signals concurrently to a predetermined number of data lines;

a video driver for previously delaying the plurality of video signals relatively in accordance with the array pitch of the pixels to thereby adjust the timing of supplying the video signals to said display panel; and a timing generator for controlling the simultaneous sampling period of said driving circuit included in said display panel and also controlling the timing of the delay process executed by said video driver, said timing generator capable of selectively switching the simultaneous sampling period and controlling the delay process timing of said video driver in response to such selective switching to thereby optimize, with respect to said simultaneous sampling period, the supply timing of the input video signals to said display panel.

2. The display device according to claim 1, wherein said video driver has a sample hold circuit to execute a process of delaying said video signals.

3. The display device according to claim 2, wherein said timing generator outputs both a latch signal to prescribe the delay process timing of said sample hold circuit and a clock signal to prescribe the simultaneous sampling period of said driving circuit, and adjusts the phase difference between said latch signal and said clock signal to thereby optimize the supply timing of the video signals.

4. A display device comprising:

a display panel having pixels arrayed at intersections of mutually orthogonal gate lines and data lines, and a driving circuit for sampling a plurality of video signals simultaneously and distributing the sampled signals concurrently to a predetermined number of data lines;

a video driver for delaying the plurality of video signals in accordance with the array pitch of the pixels and adjusting the supply timing of the video signals to said display panel; and a timing generator for controlling the timing of said simultaneous sampling while supplying a clock signal to said driving circuit included in said display panel, and also controlling the delay process of said video driver synchronously, said timing generator capable of variably controlling the delay process timing of said video driver to thereby optimize, with respect to the timing of said simultaneous sampling, the supplying timing of the input video signals to said display panel.

5. The display device according to claim 4, wherein said timing generator variably controls the delay process timing in accordance with the video-signal transfer delay caused in said video driver.

6. The display device according to claim 4, wherein said timing generator variably controls the delay process timing in accordance with the clock-signal transfer delay caused in said driving circuit.

7. The display device according to claim 4, wherein said video driver has a sample hold circuit to execute a process of delaying the video signals.

8. The display device according to claim 7, wherein said timing generator outputs a latch signal to prescribe the delay process timing of said sample hold circuit and adjusts the phase difference between said latch signal and said clock signal to thereby optimize the supply timing of the video signals.

9. A timing generator for controlling the sampling period of a driving circuit included in a display panel and also controlling the timing of a delay process executed by a video driver, said timing generator comprising:

a stage for selectively switching said sampling period, said sampling being executed in a simultaneous sampling mode which samples a plurality of video signals simultaneously; and means for controlling the delay process timing of said video driver in response to the selective switching to thereby optimize, with respect to said simultaneous sampling period, the supply timing of the input video signals to said display panel.

10. A timing generator for controlling the delay process executed by a video driver while supplying a clock signal to a driving circuit included in a display panel, said timing generator comprising:

means for controlling the timing of video signal sampling, said sampling being executed in a simultaneous sampling mode which samples a plurality of video signals simultaneously; and means for variably controlling the timing of said delay process, said variable control means including a means for optimizing, with respect to the timing of said simultaneous sampling, the supply timing of the input video signals to said display panel.

11. The timing generator according to claim 10, wherein said variable control means controls the timing of said delay process in accordance with the video-signal transfer delay caused in said video driver.

12. The timing generator according to claim 10, wherein said variable control means controls the timing of said delay process in accordance with the clock-signal transfer delay caused in said driving circuit.

* * * * *